United States Patent [19]

Isaacson et al.

[11] Patent Number: 4,878,408

[45] Date of Patent: Nov. 7, 1989

[54] APPARATUS FOR SLITTING ELONGATED FLEXIBLE TAPE

[75] Inventors: William C. Isaacson, North Hollywood; Herbert A. Farmery, Anaheim, both of Calif.

[73] Assignee: Keen Corporation, New York, N.Y.

[21] Appl. No.: 52,628

[22] Filed: May 20, 1987

[51] Int. Cl.[4] ..... B26D 1/02; B26D 7/01; B26D 7/26

[52] U.S. Cl. ..... 83/444; 83/450; 83/856

[58] Field of Search ..... 83/425–425.4, 83/433, 434, 437, 438, 444, 448, 449, 649, 856, 858, 467 R, 468, 450, 441.1

[56] References Cited

U.S. PATENT DOCUMENTS

| | | | |
|---|---|---|---|
| 2,224,070 | 12/1940 | Walter | 83/649 |
| 2,316,249 | 4/1943 | Johnson | 83/425 |
| 3,296,911 | 1/1967 | McLane | 83/437 |
| 3,961,551 | 6/1976 | Doyel | 83/858 |
| 3,971,279 | 7/1976 | Wright | 83/649 |
| 4,094,217 | 6/1978 | Exline | 83/856 |

FOREIGN PATENT DOCUMENTS

| | | | |
|---|---|---|---|
| 664764 | 5/1979 | U.S.S.R. | 83/858 |

*Primary Examiner*—Frank T. Yost
*Assistant Examiner*—Hien H. Phan
*Attorney, Agent, or Firm*—Kelly, Bauersfeld & Lowry

[57] ABSTRACT

An apparatus for slitting elongated flexible tape longitudinally into a plurality of strips of preselected width, the apparatus including a base forming a generally horizontal tape support surface and a pair of upstanding side supports, one of which functions as a side edge guide for one side edge of the tape. A shaft is mounted transversely between the side supports, and functions to support an adjustable side edge guide for abutting and guiding the other side edge of the tape, and a cutter adjustably located to slit the tape to the preselected width and having a cutting blade and a hold-down surface adjacent the blade for slidably clamping the tape during slitting to prevent lateral tape movement.

20 Claims, 2 Drawing Sheets

FIG. 1
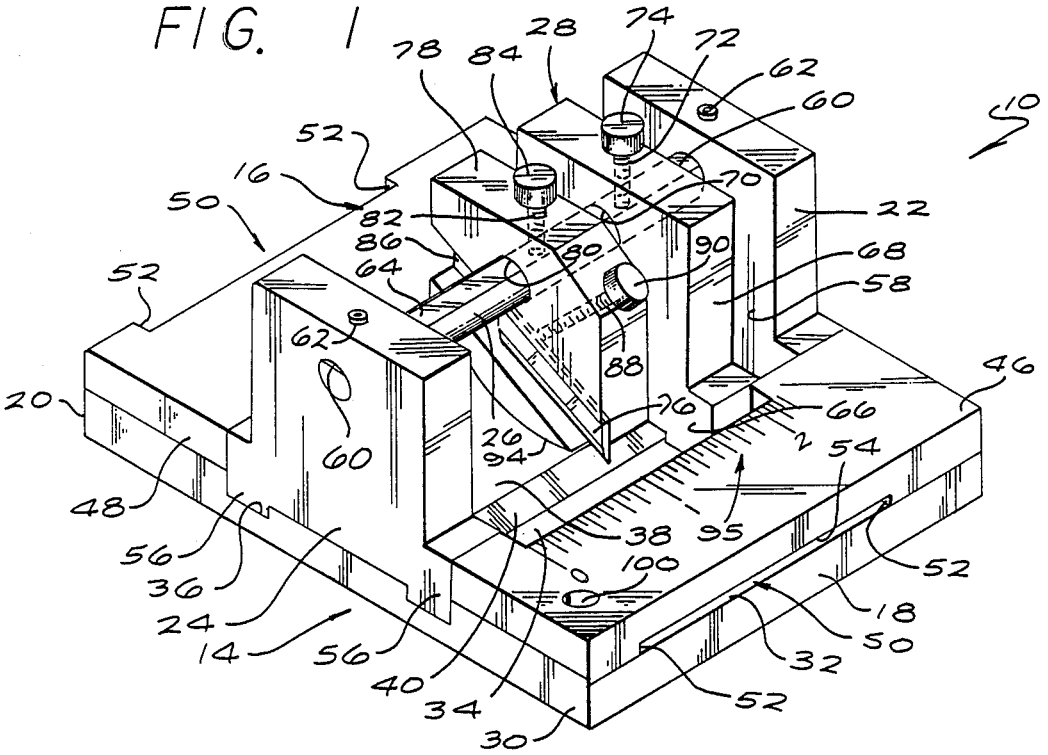
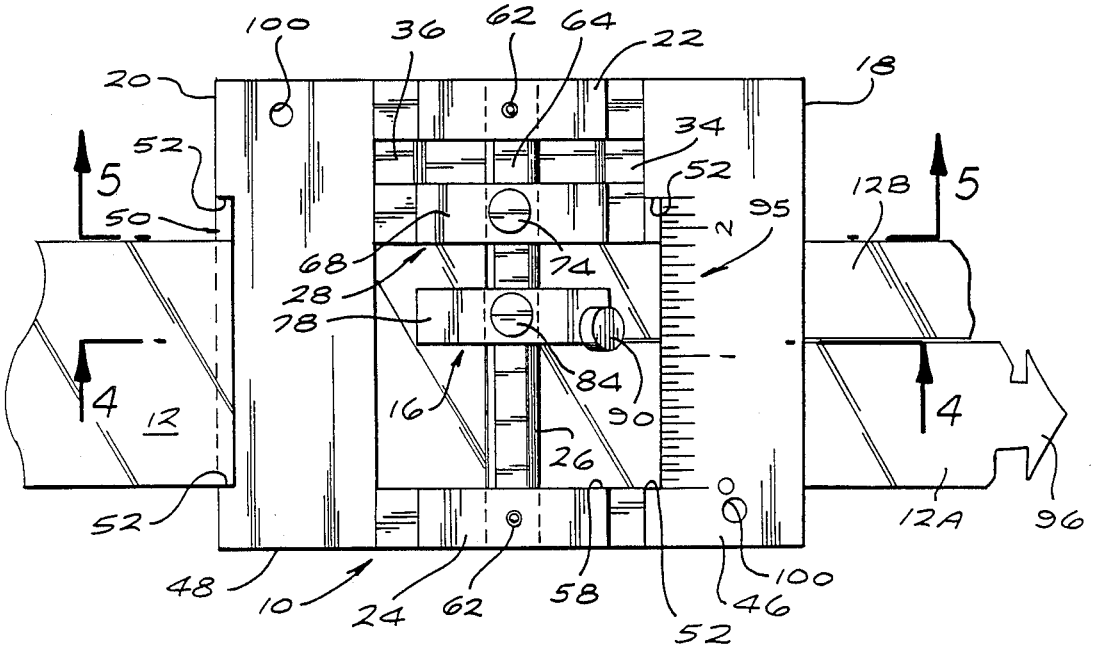

APPARATUS FOR SLITTING ELONGATED FLEXIBLE TAPE

BACKGROUND OF THE INVENTION

This invention relates to apparatus for cutting an elongated strip of material, and more particularly to a new and improved portable apparatus for longitudinally slitting an elongated strip of flexible material into a plurality of strips of preselected width.

There are many instances where it is desirable to slit elongated flexible sheet material longitudinally into a plurality of individual strips of preselected width. One such instance is that found in vehicle body repair and customizing shops where decorative stripes are applied to car, truck, van and other vehicle bodies.

Such shops generally stock relatively large rolls of decorative tape of various colors and widths, the tape typically being made of vinyl plastic having a pressure-sensitive adhesive on one side, and which must be slit to a preselected width prior to application to the vehicle body. For achieving a neat and professional appearance, it is necessary that the cut strip have a uniform width with the side edges parallel throughout the length of the strip.

To slit the tape, it is desirable to have an apparatus that is easy to use, rugged in construction, yet which is inexpensive to manufacture. The apparatus must be capable of precisely and accurately slitting tape of predetermined width into strips of many different preselected widths, and preferably should be portable and hand held to enhance its usefulness.

While attempts have heretofore been made at designing portable apparatus for slitting tape into a plurality of strips of preselected widths, such apparatus have been less than totally satisfactory. One such apparatus exemplary of those found in the prior art is that manufactured by Lexciters of Auburn, Calif., and sold under its name "The Slit-er II".

While such prior art apparatus have met with some degree of success, such apparatus tend to be cumbersome to use and adjust, and do not securely fix the tape in lateral position during slitting with the result that the cutting blade tends to produce a cut strip having side edges that are not parallel throughout their length, but rather have a somewhat wavy appearance. Moreover, with such prior art apparatus it is difficult and time-consuming to change the cutting blades during use, and frequently the blade fails to cut completely through the tape and form the desired strips.

Thus, there exists a need for a portable apparatus for longitudinally slitting elongated flexible material of predetermined width into a plurality of strips of preselected width, and which is reliable and effective in use to precisely and accurately cut the elongated material, yet which is simple in design, rugged in use, and inexpensive to manufacture. The present invention satisfies this need.

SUMMARY OF THE PRESENT INVENTION

The present invention provides a portable, hand-held apparatus that is relatively simple in design and economical to manufacture, yet is rugged in use and highly reliable and effective to accurately and precisely slit elongated flexible tape longitudinally into preselected widths. The apparatus includes a base formed in such a manner that it insures precise and accurate alignment of the tape during slitting, and an adjustable cutter for accurately and precisely slitting the tape to the desired width without permitting the tape to deform laterally during the cutting operation, thereby insuring that the side edges of the cut tape are perfectly parallel throughout its length.

The apparatus of the invention includes an adjustable side edge guide which is mounted for ready and quick adjustment to the precise width of tape to be cut, and which forms a secure and precise guide to insure that the tape remains laterally fixed during the cutting operation. The adjustable cutter is easily and precisely positioned to cut the tape accurately to the desired width, and provides a hold-down surface to insure that the tape cannot distort laterally during the slitting operation. Moreover, the cutter includes a cutting blade which penetrates deeply through the tape during cutting, and which can be easily and quickly replaced during use without the necessity of special tools or apparatus disassembly.

The base of the apparatus includes a pair of spaced channels forming a central plateau having a chamfered forward edge against which the cutting blade abuts, the hold-down surface serving to slidably clamp the tape against the plateau during cutting. The adjustable side-edge guide includes a pair of legs disposed within the channels, and is supported above the base by a transverse shaft such that once locked in position, the adjustable edge guide cannot move during use.

The cutter is rotatably supported on the shaft for lateral movement therealong to any desired position, and the cutting blade is removably attached to project downwardly and forwardly into one of the channels and against the chamfered edge. The hold-down surface is formed on the cutter adjacent the cutting blade and slidably clamps the tape against the plateau support surface to prevent lateral movement or distortion of the tape during slitting.

Many other features and advantages of the present invention will become apparent from the following detailed description taken in conjunction with the drawings which disclose, by way of example, the principles of the invention.

BRIEF DESCRIPTION OF THE DRAWINGS

FIG. 1 is a perspective view of an apparatus for slitting elongated flexible tape embodying the principles of the present invention;

FIG. 2 is a top plan view of the apparatus of FIG. 1, and showing the passage of a tape being slit by the apparatus therethrough;

DETAILED DESCRIPTION

Figure 3:
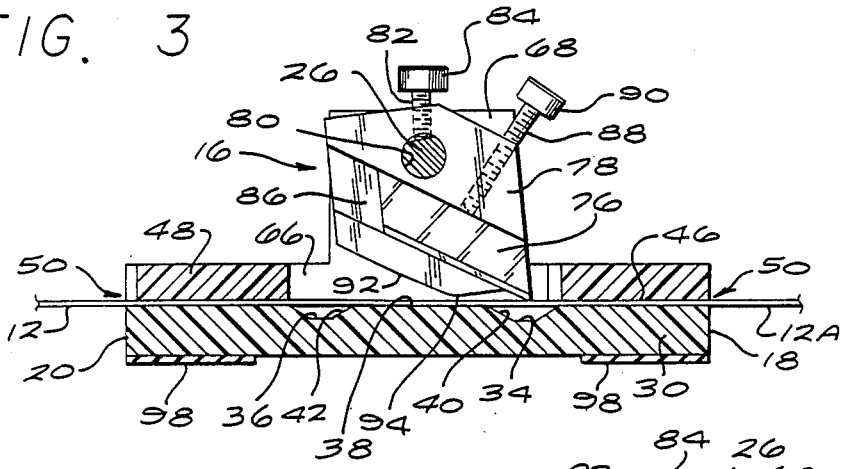
FIG. 3 is a reduced size side sectional view of the apparatus of FIG. 2, and showing a cutter positioned before adjustment into the slitting position.

As shown in the exemplary drawings, the present invention is embodied in a new and improved portable apparatus 10 for slitting elongated flexible sheet material longitudinally into a plurality of individual strips of preselected length. In this instance, the apparatus 10 is primarily intended to be hand-held and used to slit sheet material such as decorative vinyl tape 12 longitudinally into two individual strips 12A and 12B (see FIG. 2).

Typically, such decorative vinyl tape 12 is supplied in rolls (not shown) of assorted colors and widths, usually up to about 6 inches, and has a thickness on the order of 2 to 6 mils with a pressure sensitive adhesive coated on one side and protected before use by a release backing material.

In accordance with the present invention, the apparatus 10 is relatively simple in design and economical to manufacture, yet is rugged in use and highly reliable and effective to accurately and precisely slit the tape 12 longitudinally herein to widths from 2 inches to ⅛ inch or less. Toward these ends, the apparatus 10 includes a base 14 formed in such a manner that it insures precise and accurate alignment of the tape 12 during slitting, and an adjustable cutter 16 for accurately and precisely slitting the tape to the desired width without permitting the tape to deform laterally during the cutting operation.

As best can be seen in FIG. 1, the base 14 of the apparatus 10 is generally rectangular and block shaped having front and rear ends 18 and 20, respectively, and has attached thereto a pair of laterally spaced upstanding rectangular side supports 22 and 24 projecting above the base intermediate the front and rear ends. Extending between the side supports 22 and 24 above the base 14 is a generally horizontal support shaft 26 to which is adjustably mounted the cutter 16 and an adjustable edge guide 28.

As seen in FIGS. 1 and 3, the base 14 herein is formed by a block shaped lower section 30 having a flat upper face 32 with forward and rear, transverse, generally rectangular recesses 34 and 36 formed in the upper face and extending across the lower section parallel to the front and rear ends 18 and 20. The forward and rear recesses 34 and 36 are spaced apart so as to form an upstanding flat-topped plateau 38 extending between the side supports 22 and 24. For reasons that will become more apparent hereinafter, the front and rear edges 40 and 42 of the plateau 38 are chamfered at an angle of about 30 degrees, as is the forward edge 44 of the forward recess 34.

Disposed in overlying relation to the upper face 32 of the lower section 30 and secured thereto on either end of the side supports 22 and 24 are a pair of forward and rear cover blocks 46 and 48 which extend between the side supports and, respectively, the front and rear ends 18 and 20 of the base 14. Formed in the underside of each of the cover blocks 46 and 48 is a downwardly open recess 50 which cooperates with the upper face 32 of the lower section 30 to define a rectangular-shaped passageway through the base 14, and through which the tape 12 can pass. The recesses 50 are each formed by short vertical sidewalls 52 dimensioned to be slightly longer than the thickness of the tape 12, and a top wall 54, the vertical sidewalls 52 being spaced laterally apart by an amount at least equal to the width of the tape 12 prior to cutting. With this construction, the base 14 includes an entrance passageway extending under the rear cover block 48 from the rear end 20 to the area of the plateau 38, and an exit passageway from the area of the plateau under the forward cover block 46 to the front end 18, the central area of the lower section 30 between the side supports 22 and 24 being upwardly open to expose the plateau area from above.

Each of the side supports 22 and 24 is secured in fixed relation to the base 14 and herein has a pair of downwardly directed legs 56 which mate and fit within the foreward and rear recesses 34 and 36, and has a flat inner surface 58 facing the plateau 38. The support shaft 26 is coupled to the side supports 22 and 24, herein by extending through a pair of holes 60 formed adjacent the upper end, and is secured in position by set screws 62 projecting downwardly from the upper ends into engagement with the shaft end portions. Preferably, the shaft 26 is formed with a flat 64 extending along its length and onto which the screws 62 engage to clamp the shaft against rotation within the holes 60.

As best seen in FIGS. 1 and 2, the inner surface 58 of the left side support 24 is aligned to be parallel with the left vertical sidewall 52 of the recess 50 in the forward and rear cover blocks 46 and 48 so as to form a continuous, straight and flat side between the front and rear ends 18 and 20 of the base 14. This structure permits the left side support 24 to act as a fixed guide for the left side edge of the tape 12 as the tape is passed through the passageway 50.

Figure 5:
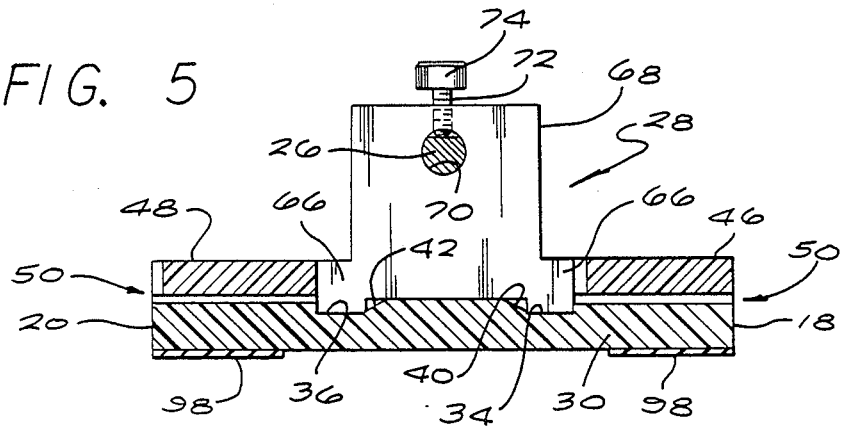
FIG. 5 is a view similar to FIG. 4 and taken along the line 5—5 of FIG. 2.

In accordance with one aspect of the present invention, the adjustable edge guide 28 is mounted to the shaft 26 in such a manner as to permit ready and quick adjustment to the precise width of tape 12 to be cut, and forms a secure and precise guide for the right edge of the tape as the tape is passed over the plateau 38. As best can be seen in FIG. 5, the adjustable edge guide 28 has a shape generally similar to that of the side supports 22 and 24, and includes a pair of downwardly directed legs 66 which mate with and slidably fit within the forward and rear recesses 34 and 36, and an upstanding wall portion 68 having a smooth, flat inner surface. Adjacent the upper end of the wall portion 68 is a hole 70 through which the shaft 26 projects, the hole being sized to permit the adjustable guide 28 to be freely moved along the shaft.

To clamp the adjustable guide 28 in any selected position along the shaft 26, a threaded screw 72 having an enlarged head 74 extends through a threaded hole in the top of the wall portion 68, and can be threaded into clamping engagement with the flat 64 on the shaft. With this arrangement, the adjustable guide 28 can be positioned to abut and form a firm side edge guide for the right edge of the tape 12, and when clamped in position, will form a flat side edge guide parallel with that of the fixed edge guide formed by the left side support 24, the legs 66 and screw 72 cooperating to solidly fix the adjustable guide relative to the base 14 so that the adjustable guide will not move during the slitting operation.

In accordance with another and primary feature of the present invention, the cutter 16 can be easily and precisely positioned to slit the tape 12 to any desired width, and provides a means to insure that the tape will not distort laterally during the slitting operation thereby insuring that a straight, true cut is achieved with the cut edge of the tape being substantially parallel with the uncut side edge. Moreover, the cutter 16 includes a cutting blade 76 which is mounted in such a manner as to permit quick and easy blade replacement during use without requiring special tools or apparatus disassembly.

Toward the foregoing ends, the cutter 16 includes a mounting block 78 having a through hole 80 through which the shaft 26 extends in a manner similar to that of the adjustable edge guide 28, and is disposed between the adjustable guide and the left side support 24 for movement to selected positions therebetween. A threaded screw 82 having an enlarged head 84 projects through the top of the mounting block 78 for engagement with the shaft 26 to lock the cutter 16 in any preselected position.

To mount the cutting blade 76, the mounting block 78 is formed with a laterally opening channel 86 herein formed in the left side face of the mounting block and opening toward the left side support 24. The channel 86 is formed to have a height substantially equal to the height of the blade 76, the blade herein being a single edge blade of conventional type such as that sold by Stanley under its model number 11-300, and extends downwardly and forwardly from the rear of the mounting block to the front at an angle approximately equal to the angle of the chamfer formed on the forward edge 40 of the plateau 38.

The cutting blade 76 is retained in the channel 84 by a threaded screw 88 having an enlarged head 90, and which projects through a threaded bore formed in the forward upper portion of the mounting block 78. The lower end of the screw 88 projects into the channel 86 and releasably engages the top of blade 78, thereby clamping the blade downwardly against the lower edge of the channel.

To prevent the tape 12 from distorting during the slitting operation, the bottom portion 92 of the mounting block 78 includes a hold-down surface 94 projecting rearwardly from the cutting blade 78 and which is parallel to the upper surface of the plateau 38 during the slitting operation. The hold-down surface 94 is formed to slidably clamp the tape 12 over the plateau 38 by lightly pressing downwardly against the upper surface of the tape when the mounting block 78 is locked in the cutting position, and is formed to permit the cutting edge of the block to project downwardly into the forward recess 34.

To operate the apparatus 10, the cutter 16 is initially rotated to a non-slitting position, such as shown in FIG. 3 with the cutting blade 76 disposed above the forward channel 34. The leading edge of the tape 12 to be slit is then threaded from its supply roll through the entrance passageway 50, over the plateau 38 and out of the exit passageway. The adjustable edge guide 28 is then moved laterally along the shaft 26 until the left side edge of the tape 12 is against the left side support 24 and the right side edge abuts the wall portion 68 of the adjustable guide. The screw 72 of the adjustable guide 28 is then tightened by turning the enlarged head 74 to lock the adjustable guide in position.

Figure 4:
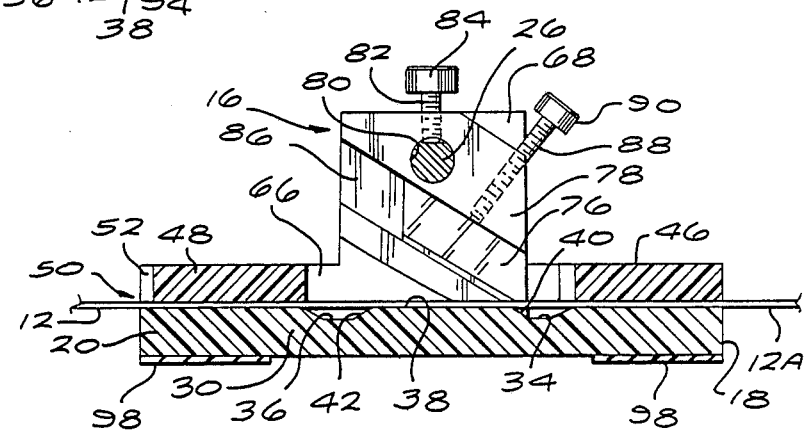
FIG. 4 is a side sectional view similar to FIG. 3 and taken along the line 4—4 of FIG. 2.

Having determined the desired width to which the tape 12 is to be cut, the cutter 16 is moved along the shaft 26 to the desired position, a scale 95 being preferably provided on the forward cover block 46 for precise alignment of the cutting blade 76 to the desired position, and the cutter is then rotated to the cutting position shown in FIG. 4 with the cutting edge of the blade abutting the front edge 40 of the plateau 38. The screw 82 of the cutter 16 is then tightened by turning the enlarged head 84 to securely lock the cutter in the desired position.

It should be noted that when the cutter 16 is rotated about the shaft 26 to the cutting position, the hold-down surface 94 will clamp the tape 12 against the plateau 38, and the cutting blade 76 will depress the tape downwardly along the chamfer of the front edge 40. Since the blade 76 extends into the forward recess 34 parallel with the chamfer of the front edge 40, the blade performs its slitting function against the chamfer, thereby insuring deep blade penetration through the tape 12. Deep penetration of the blade 76 insures an accurate and precise cut, and the clamping action of the hold-down surface 94 prevents the tape from distorting laterally during the cutting operation.

To slit the tape 12, all that need be done is to pull the tape forwardly as indicated by the arrow 96 in FIG. 2. While the apparatus 10 is primarily intended to be hand held during use, it may equally be held on a flat surface, non-skid cushioning pads 98 being provided on the underside of the base 14 to retard movement of the apparatus as the tape 12 is pulled therethrough. Should it be desired to permanently mount the apparatus 10 on a work surface, mounting holes 100 are provided through the base 14 for screws or the like.

Should it be necessary to change the cutting blade 76 during use, all that need be done is to untighten the screw 88 by turning the enlarged head 90 to release the blade, and then remove the blade from the channel 86 such as by sliding the blade rearwardly along the channel. A new blade 76 can then be inserted into the channel 86 and secured in position by retightening the screw 88. With this procedure, the cutter 16 need not be moved, and the alignment not altered. However, in some situations where very narrow strips are being cut, it may be necessary to release the cutter 16 by rotating the screw 82 of the mounting block 78 and rotating the mounting block about the shaft 26 to an inoperative position where the blade can be easily removed and replaced.

For sturdy and rugged construction, the base 14, mounting block 78 and adjustable edge guide 28 are preferably formed of ABS plastic, and the shaft 26 of stainless steel. Also, the enlarged heads 74, 84 and 90 of the screws 72, 82 and 88 can be color-coded to facilitate selection of the proper screw for adjustment. Further, while only one cutter 16 has been illustrated in the drawings, it will be appreciated that additional cutters can be coupled to the shaft 26 to permit slitting of the tape 12 into more than two strips of preselected width.

From the foregoing, it should be apparent that the present invention provides a reliable and effective apparatus 10 for longitudinally slitting elongated flexible tape of predetermined width into a plurality of strips of preselected width. Further, the apparatus 10 is relatively simple in design and economical to manufacture yet is rugged and easy to use to accurately and precisely slit the tape 12 to the preselected widths.

While a particular form of the invention has been illustrated and described, it will be apparent that various modifications can be made without departing from the spirit and scope of the invention.

We claim:

1. A portable apparatus capable of being held by hand during use for slitting an elongated strip of flexible material of predtermined width longitudinally into a plurality of strips of preselected width, said apparatus comprising:

a base having a generally rectangular shape with longitudinally spaced front and rear ends and laterally spaced sides, said base forming a generally horizontal support surface for the strip of flexible material and including an upwardly open and laterally extending channel formed therein, said channel having a sloping wall extending from said support surface to the base of said channel and defining therebetween an edge;

a first side edge guide fixed to said base and having a first guide surface disposed to be engaged by and extend parallel to one side edge of said strip of flexible material;

a second side edge guide adjustably mounted to said base and having a second guide surface disposed parallel with said first guide surface, said second side edge guide being adjustable relative to said base to a position laterally spaced from said first side guide by an amount substantially equal to the predetermined width of said strip of flexible material whereby said second guide surface is engaged by the opposite side edge of said strip of flexible material; and a cutter adjustably mounted to said base and disposed laterally between said first and said second side edge guides, said cutter including a mounting block and a cutter blade removably secured thereto, a portion of said blade projecting downwardly from said block into said channel substantially parallel to said sloping wall to slit said strip of flexible material into the plurality of strips of preselected width, said block including a hold down surface disposed substantially parallel with said support surface forwardly of said channel to slidably clamp the strip of flexible material against said support surface adjacent said blade to prevent distortion of said strip of flexible material during said slitting by said blade.

2. An apparatus as set forth in claim 1 wherein said base includes a pair of laterally spaced upstanding side supports, one of said side supports defining said first side edge guide.

3. An apparatus as set forth in claim 2 including a shaft extending between said side supports above said support surface, said shaft supporting said second side edge guide and said cutter.

4. An apparatus as set forth in claim 3 wherein said second side edge guide and said cutter are each adjustably mounted to said shaft for lateral movement therealong between said pair of side supports.

5. An apparatus as set forth in claim 4 including first and second threaded screw means engagable with said shaft and coupled, respectively, to said second side edge guide and said cutter for releasably securing said second side edge guide and said cutter in preselected positions along said shaft.

6. An apparatus as set forth in claim 5 wherein said channel has at least one chamfered edge extending from said support surface to the base of said channel, said cutting blade engaging said chamfered edge during said slitting of said tape.

7. An apparatus as set forth in claim 6 wherein said second side edge guide includes a leg projecting into said channel to prevent rotation of said second side edge guide about said shaft.

8. An apparatus as set forth in claim 7 wherein said cutter is rotatably supported by said shaft such that said cutting blade can be moved from engagement with said chamfer to a position spaced above said channel.

9. An apparatus as set forth in claim 8 wherein said means for slidably clamping said tape comprises a generally flat surface area formed on said cutter and disposed in parallel overlying relative to the top of said tape during said slitting.

10. An apparatus for slitting an elongated flexible tape of predetermined width into a plurality of individual strips of preselected width, said apparatus comprising:

a generally rectangular-shaped base having front and rear ends and a passageway formed therethrough, said passageway being generally rectangular in cross-section and having an entrance end and an exit end and defining a generally flat support surface therebetween;

first and second side supports secured to and upstanding from said base intermediate said front and rear ends, said side supports being laterally spaced apart a distance at least equal to said predeterminedl width of said tape;

an opening formed in said base between said first and second side supports and exposing said support surface from above;

a support shaft extending horizontally between said first and second side supports above said exposed support surface;

an adjustable side edge guide supported by said shaft between said first and second side supports, said adjustable side edge guide being laterally movable along said shaft;

means for securing said adjustable side edge guide in a selected position along said shaft;

a cutter supported by said shaft between said adjustable side edge guide and said first side support, said cutter being laterally movable along said shaft;

means for securing said cutter in a selected position along said shaft;

an upwardly open channel formed in said support surface and extending laterally across said base below said opening and forwardly of said shaft, said channel having a chamfered edge extending downwardly and forwardly from said support surface to the bottom of said channel; and a cutting blade secured to said cutter and projecting downwardly and forwardly along said chamfered edge into said channel.

11. An apparatus as set forth in claim 10 wherein said support surface includes a second upwardly open channel extending laterally across said base below said opening and rearwardly of said shaft, and said adjustable side edge guide includes a pair of legs, each of said legs being slidably disposed in each of said channels and having an inner surface therebetween forming a side edge guide for abutment with one side edge of said tape.

12. An apparatus as set forth in claim 10 wherein said cutter includes a hold-down surface adapted to slidably clamp said tape on said support surface adjacent said channel.

13. An apparatus as set forth in claim 10 wherein said cutting blade is removably secured to said cutter.

14. An apparatus as set forth in claim 10 wherein said cutter comprises a block rotatably supported on said shaft and projecting outwardly therefrom, said block including a hold-down surface adapted to slidably clamp said tape to said support surface adjacent said cutting blade.

15. An apparatus as set forth in claim 14 wherein said block includes a downwardly and forwardly extending groove and said cutting blade is removably secured to said block within said groove to project therefrom in a direction parallel with said chamfered edge during said slitting of said tape.

16. An apparatus as set forth in claim 15 wherein said block includes a threaded screw projecting into said groove and engagable with said cutting blade to releasably clamp said block to said cutter.

17. An apparatus as set forth in claim 10 wherein said means for securing said cutter and said means for securing said adjustable side edge guide each comprise a threaded screw engagable with said shaft.

18. An apparatus as set forth in claim 10 wherein, said first side support includes a generally straight, flat inner surface adapted to engage and form a guide surface for one side edge of said tape, and said adjustable side edge guide includes a generally straight, flat surface parallel to said inner surface and adapted to form a guide surface for the laterally opposite side edge of said tape.

19. An apparatus as set forth in claim 18 wherein said cutter includes a hold-down surface adapted to slidably clamp said tape on said support surface adjacent said channel.

20. An apparatus as set forth in claim 19 wherein said cutting blade is removably secured to said cutter.

* * * * *